US008525770B2

(12) United States Patent
Shin

(10) Patent No.: US 8,525,770 B2
(45) Date of Patent: Sep. 3, 2013

(54) LIQUID CRYSTAL DISPLAY DEVICE HAVING A TIMING CONTROLLER AND DRIVING METHOD THEREOF

(75) Inventor: Jung Wook Shin, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1051 days.

(21) Appl. No.: 11/643,816

(22) Filed: Dec. 22, 2006

(65) Prior Publication Data

US 2007/0279361 A1 Dec. 6, 2007

(30) Foreign Application Priority Data

Jun. 5, 2006 (KR) ..... 10-2006-0050607

(51) Int. Cl.
*G09G 3/36* (2006.01)

(52) U.S. Cl.
USPC ..... 345/98; 345/87; 345/99

(58) Field of Classification Search
USPC ..... 345/87, 98, 99
See application file for complete search history.

(56) References Cited

U.S. PATENT DOCUMENTS

| | | | | |
|---|---|---|---|---|
| 5,353,405 | A * | 10/1994 | Doi et al. | 345/540 |
| 5,856,816 | A * | 1/1999 | Youn | 345/98 |
| 6,614,424 | B1 * | 9/2003 | Kim et al. | 345/213 |
| 6,867,759 | B1 * | 3/2005 | Baek et al. | 345/99 |
| 2002/0024487 | A1 * | 2/2002 | Sako | 345/87 |
| 2004/0222959 | A1 * | 11/2004 | Lin et al. | 345/98 |
| 2005/0195671 | A1 * | 9/2005 | Taguchi | 365/203 |
| 2006/0262070 | A1 * | 11/2006 | Lee | 345/98 |
| 2008/0144345 | A1 * | 6/2008 | Nishiyama et al. | 365/49.17 |

FOREIGN PATENT DOCUMENTS

| | | |
|---|---|---|
| JP | 62-249193 | 10/1987 |
| JP | 6-118903 | 4/1994 |
| JP | 2002-32064 | 1/2002 |
| JP | 2006-65279 | 3/2006 |

* cited by examiner

*Primary Examiner* — Kwang-Su Yang
(74) *Attorney, Agent, or Firm* — Morgan, Lewis & Bockius LLP

(57) ABSTRACT

A liquid crystal display device includes a liquid crystal display panel including a liquid crystal display panel provided a plurality of data lines; a data distributor distributing input data; a first and second memories equally storing data to be supplied to an odd-numbered data line among data distributed by the data distributor; a third and fourth memories equally storing data to be supplied to an even-numbered data line among data distributed by the data distributor; and a clock generator generating a divided clock reading and outputting a data stored at the first and second memories or the third and fourth memories.

16 Claims, 6 Drawing Sheets

LIQUID CRYSTAL DISPLAY DEVICE HAVING A TIMING CONTROLLER AND DRIVING METHOD THEREOF

This application claims the benefit of Korean Patent Application No. 10-2006-0050607 filed in Korea on Jun. 5, 2006, which is hereby incorporated by reference in its entirety.

BACKGROUND OF THE INVENTION

1. Field of the Invention

Embodiments of the present invention relate to a liquid crystal display device, and more particularly to a method of driving a liquid crystal display device.

2. Description of the Related Art

Generally, a liquid crystal display (LCD) device controls light transmittance of liquid crystal cells in accordance with video signals to thereby display a picture. Among LCD devices, an active matrix LCD device has a switching device at each liquid crystal cell. The active matrix LCD device is advantageous for displaying a moving picture because of the control provided by the switching device. The switching device used for the active matrix LCD device may be, for example, a thin film transistor (TFT).

FIG. 1 shows a circuit diagram of a pixel in a liquid crystal display device in accordance with the related art. Referring to FIG. 1, the active matrix LCD device includes gate lines GL and data lines DL crossing each other. Each crossing of one of the gate lines with one of the data lines define a pixel. A liquid crystal cell Clc is provided at each pixel. The active matrix LCD device converts a digital input data into an analog data voltage based on a gamma reference voltage. The analog voltage is supplied to one of the data lines DL. A scanning pulse is concurrently supplied to one of the gate lines GL to thereby charge the liquid crystal cell Clc.

A gate electrode of the TFT is connected to the gate line GL while a source electrode thereof is connected to the data line DL. Further, a drain electrode of the TFT is connected to a pixel electrode of the liquid crystal cell Clc and to one electrode of a storage capacitor Cst. A common electrode of the liquid crystal cell Clc is supplied with a common voltage Vcom. The storage capacitor Cst can be charged with the data voltage provided from the data line DL when the TFT is turned-on. Thus, the storage capacitor Cst maintains a substantially constant voltage at the liquid crystal cell Clc.

The TFT is turned on by the scanning pulse applied to the gate line GL to provide a channel between the source electrode and the drain electrode thereof. Thus, the TFT supplies a voltage from the data line DL to the pixel electrode of the liquid crystal cell Clc. An alignment direction of liquid crystal molecules from the liquid crystal cell is changed by an electric field between the pixel electrode and the common electrode, thereby modulating an incident light.

FIG. 2 shows a schematic diagram of an LCD device in accordance with the related art. Referring to FIG. 2, the LCD device 100 includes an LCD panel 110 including a thin film transistor (TFT) that drives a liquid crystal cell Clc at a each crossing of one of data lines DL1 to DLm and one of gate lines GL1 to GLn, a data driver 120 supplying a data to the data lines DL1 to DLm of the liquid crystal display panel 110, and a gate driver 130 supplying a scanning pulse to the gate lines GL1 to GLn of the liquid crystal display panel 110. A gamma reference voltage generator 140 generates a gamma reference voltage to be supplied to the data driver 120. A backlight assembly 150 irradiates light onto the liquid crystal display panel 110. An inverter 160 inverts an alternating current to power the backlight assembly 150. A common voltage generator 170 generates a common voltage Vcom to be supplied to the common electrode of the liquid crystal cell Clc of the liquid crystal display panel 110. A gate driving voltage generator 180 generating a gate high voltage VGH and a gate low voltage VGL to be supplied to the gate driver 130. A timing controller 190 controls the data driver 120 and the gate driver 130.

The LCD panel 110 has a liquid crystal material injected between two glass substrates (not shown). The data lines DL1 to DLm and the gate lines GL1 to GLn perpendicularly cross each other on the lower glass substrate of the LCD panel 110. A TFT is provided at each crossing of one of the data lines DL1 to DLm with one of the gate lines GL1 to GLn. The TFT supplies a data from the data lines DL1 to DLm to the liquid crystal cell Clc in response to the scanning pulse.

The gate electrode of the TFT is connected to the gate lines GL1 to GLn while the source electrode thereof is connected to the data line DL1 to DLm. Further, the drain electrode of the TFT is connected to the pixel electrode of the liquid crystal cell Clc and to the storage capacitor Cst. The TFT is turned on by the scanning pulse applied through the gate lines GL1 to GLn to the gate terminal thereof. Then, the TFT supplies a video data from the data line DL1 to DLm to the pixel electrode of the liquid crystal cell Clc.

The gamma reference voltage generator 140 receives a high-level supply voltage VDD to generate a positive gamma reference voltage RV1 and a negative gamma reference voltage RV2. The gamma reference voltage generator 140 provides the positive gamma reference voltage RV1 and the negative gamma reference voltage RV2 to the data driver 120.

The data driver 120 samples and latches a digital data, such as a RGB digital video data or a RGB digital image data, from the timing controller 190 in response to a DDC signal from the timing controller 190. Then, the data driver 120 converts the sampled digital data into an analog data voltage corresponding to a gray scale level at the liquid crystal cell Clc of the LCD panel 110 in accordance with the positive and negative gamma reference voltages RV1 and RV2 from the gamma reference voltage generator 140. Then, the data driver 120 supplies the analog data voltage to the data lines DL1 to DLm.

The gate driving voltage generator 180 is supplied with a high-level supply voltage VDD to generate a gate high voltage VGH and a gate low voltage VGL. The gate driving voltage generator 180 supplies the gate high voltage VGH and the gate low voltage VGL to the gate driver 130. Herein, the gate high voltage VGH is larger than a threshold voltage of the TFT provided at each pixel of the LCD panel 110 and the gate low voltage VGL is lower than the threshold voltage of the TFT.

The gate driver 130 sequentially generates a gate pulse as a scanning pulse in response to a GDC signal and a gate shift clock GSC from the timing controller 190. The gate driver 130 supplies the scanning pulse to the gate lines GL1 to GLn. The gate driver 130 determines a high level voltage and a low level voltage of the scanning pulse in accordance with the gate high voltage VGH and the gate low voltage VGL from the gate driving voltage generator 180.

The inverter 160 converts an internally generated square wave signal into a triangular wave signal, and then compares the generated triangular wave signal with a direct current (DC) voltage VCC from said system. Then, the inverter 160 generates a burst dimming signal proportional to a result of the comparison. Then, a driving integrated circuit (IC) (not shown) controls a generation of AC voltage and current supplied to the backlight assembly 150 in response to the burst dimming signal.

The backlight assembly 150 is provided at the rear side of the LCD panel 110. The backlight assembly 150 is powered by the AC voltage from the inverter 160. The backlight assembly 150 irradiates light onto the LCD panel 110. The irradiated light from the backlight assembly 150 is incident onto each pixel of the LCD panel 110 including the liquid crystal cell Clc therein.

The common voltage generator 170 receives a high-level power voltage VDD to generate a common voltage Vcom. The common voltage generator 170 supplies the common voltage Vcom to the common electrode of the liquid crystal cell Clc provided at each pixel of the LCD panel 110.

The timing controller 190 supplies a digital data, such as a digital video RGB data or a digital RGB image data, to the data driver 120. The digital data may be outputted by an image processing scaler (not shown) in a system such as a TV set or a computer monitor, etc. The timing controller 190 also generates a data driving control (DCC) signal and a gate driving control (DGC) signal using horizontal/vertical synchronizing signals H and V in response to a clock signal CLK. The timing controller 190 supplies the DDC and the GDC signals to the data driver 120 and the gate driver 130, respectively. The DDC signal may include a source shift clock (SSC), a source start pulse (SSP), a polarity control signal (POL), and a source output enable signal (SOE), etc. The GDC signal may include a gate start pulse (GSP) and a gate output enable signal (GOE), etc.

FIG. 3 shows a schematic description of a timing controller in accordance with the related art. Referring to FIG. 3, the timing controller 190 includes a first memory part 191, a second memory part 192, a clock generator 193, and a parallel-to-serial converter 194. Herein, the first memory part 191 stores an input data to be supplied to an odd-numbered data line. The second memory part 192 stores an input data to be supplied to an even-numbered data line. The clock generator 193 generates clock signals for controlling reading and outputting stored data from one of the first memory part 191 and the second memory part 192.

The clock generator 193 receives an input main clock (MAIN CLK) signal and generates four divided clock signals to control reading operations from the first and second memory parts 191 and 192. The clock generator 193 alternatively supplies the four divided clocks signals to the first and second memory parts 191 and 192. The four divided clocks signals control a reading operation of 72 bits of stored data from one of the first memory part 191 and the second memory part 192.

The first memory part 191 stores an 18-bit input data at each divided clock cycle. Thus, the first memory part 191 can store 72 bits of input data during a period of four divided clocks from the clock generator 193. Data stored in the first memory part 191 correspond to an odd-numbered data line.

Similarly, the second memory part 192 stores an 18-bit input data at each divided clock cycle. Thus, the second memory part 192 can store 72 bits of input data during a period of four divided clocks from the clock generator 193. Data stored in the second memory part 192 correspond to an even-numbered data line.

The parallel-to-serial converter 194 converts the parallel data read from one of the first memory part 191 and the second memory part 192 into a serial data. The serial data from the parallel-to-serial converter 194 is outputted to the data driver 120 (shown in FIG. 2). For example, each of the 72 bits of stored data in the first memory part 191 is outputted to the parallel-to-serial converter 194 in parallel with a corresponding one of the 72 bits of stored data in the second memory part 192.

In the related art LCD device, the timing controller 190 reads 72 bits of data into one of the first memory part 191 and the second memory part 192 during a period of four divided clock signals. Thus, the related art LCD device has a large blank section following a data enable signal.

SUMMARY OF THE INVENTION

Accordingly, embodiments of the present invention are directed to an LCD device and driving method thereof that substantially obviate one or more problems due to limitations and disadvantages of the related art.

An object of the present invention to provide an LCD device and a driving method thereof that substantially reduces an input data reading time.

Another object of the present invention to provide an LCD device and a driving method thereof that substantially reduces a blank section of a data enable signal inputted from a system.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these objects and other advantages and in accordance with the purpose of the invention, as embodied and broadly described herein, a liquid crystal display device includes a liquid crystal display panel including a first plurality and a second plurality of data lines; first, second, third and fourth storage parts; a data distributor for evenly distributing first input data between a first stored data into the first storage part and a second stored data into the second storage part and for evenly distributing second input data between a third stored data into the third storage part and a fourth stored data into the fourth storage part; and a parallel-to-serial-converter simultaneously converting the first and second stored data from the first and second storage parts into a first serial data and outputting the first serial data during a first plurality of divided clock cycles and simultaneously converting the third and fourth stored data from the third and fourth storage parts into a second serial data and outputting the second serial data during a second plurality of divided clock cycles.

In another aspect, a liquid crystal display device includes a liquid crystal display panel including a first plurality and a second plurality of data lines; a parallel-to-serial converter outputting a first serial data during a first plurality of divided clock cycles and outputting a second serial data during a second plurality of divided clock cycles; and a data driver evenly distributing the first serial data to odd-numbered data lines from each of the first plurality and the second plurality of data lines.

In another aspect, a method is presented for driving a liquid crystal display device including a liquid crystal display panel with a plurality of data lines, and first, second, third, and fourth storage parts. The method includes dividing the plurality of data lines a first plurality and a second plurality of data lines; evenly distributing first input data between a first stored data into the first storage part and a second stored data into the second storage part and evenly distributing second input data between a third stored data into the third storage part and a fourth stored data into the fourth storage part; simultaneously converting the first and second stored data from the first and second storage parts into a first serial data and outputting the first serial data during a first plurality of divided clock cycles; and simultaneously converting the third and fourth stored data from the third and fourth storage parts into a second serial data and outputting the second serial data during a second plurality of divided clock cycles.

It is to be understood that both the foregoing general description and the following detailed description of the present invention are exemplary and explanatory and are intended to provide further explanation of the invention as claimed.

BRIEF DESCRIPTION OF THE DRAWINGS

These and other objects of the invention will be apparent from the after detailed description of the embodiments of the present invention with reference to the accompanying drawings, in which.

DETAILED DESCRIPTION OF AN EXEMPLARY EMBODIMENT

Figure 1:
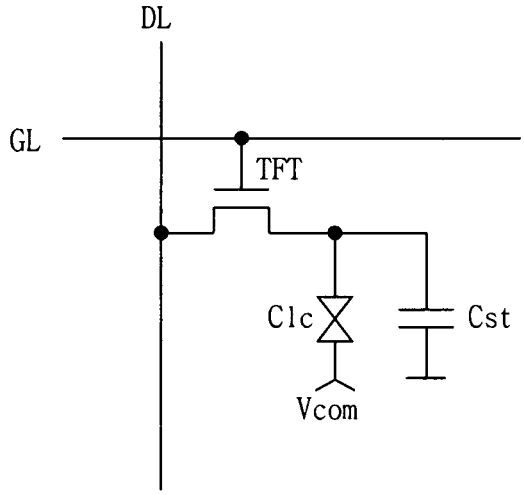
FIG. 1 RELATED ART
FIG. 1 shows a circuit diagram of a pixel in an LCD device in accordance with the related art.
Figure 2:
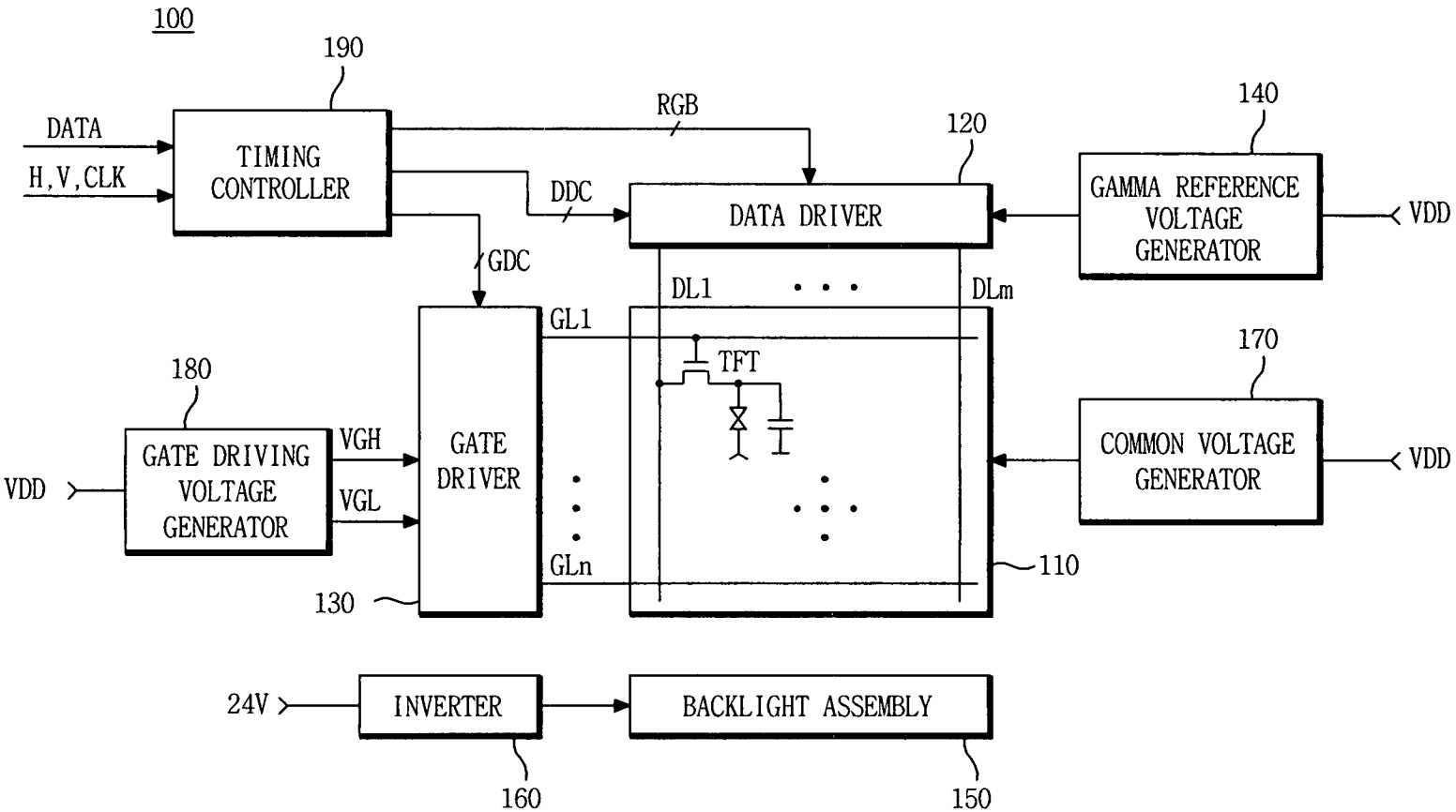
FIG. 2 RELATED ART
FIG. 2 shows a schematic diagram of an LCD device in accordance with the related art.
Figure 3:
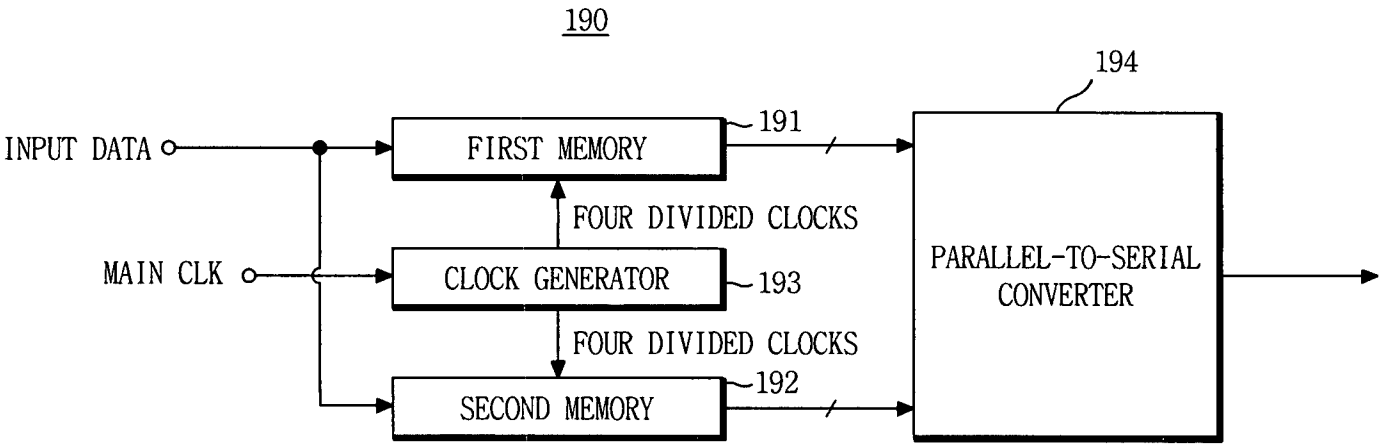
FIG.3 RELATED ART
FIG. 3 shows a schematic description of a timing controller in accordance with the related art.
Figure 4:
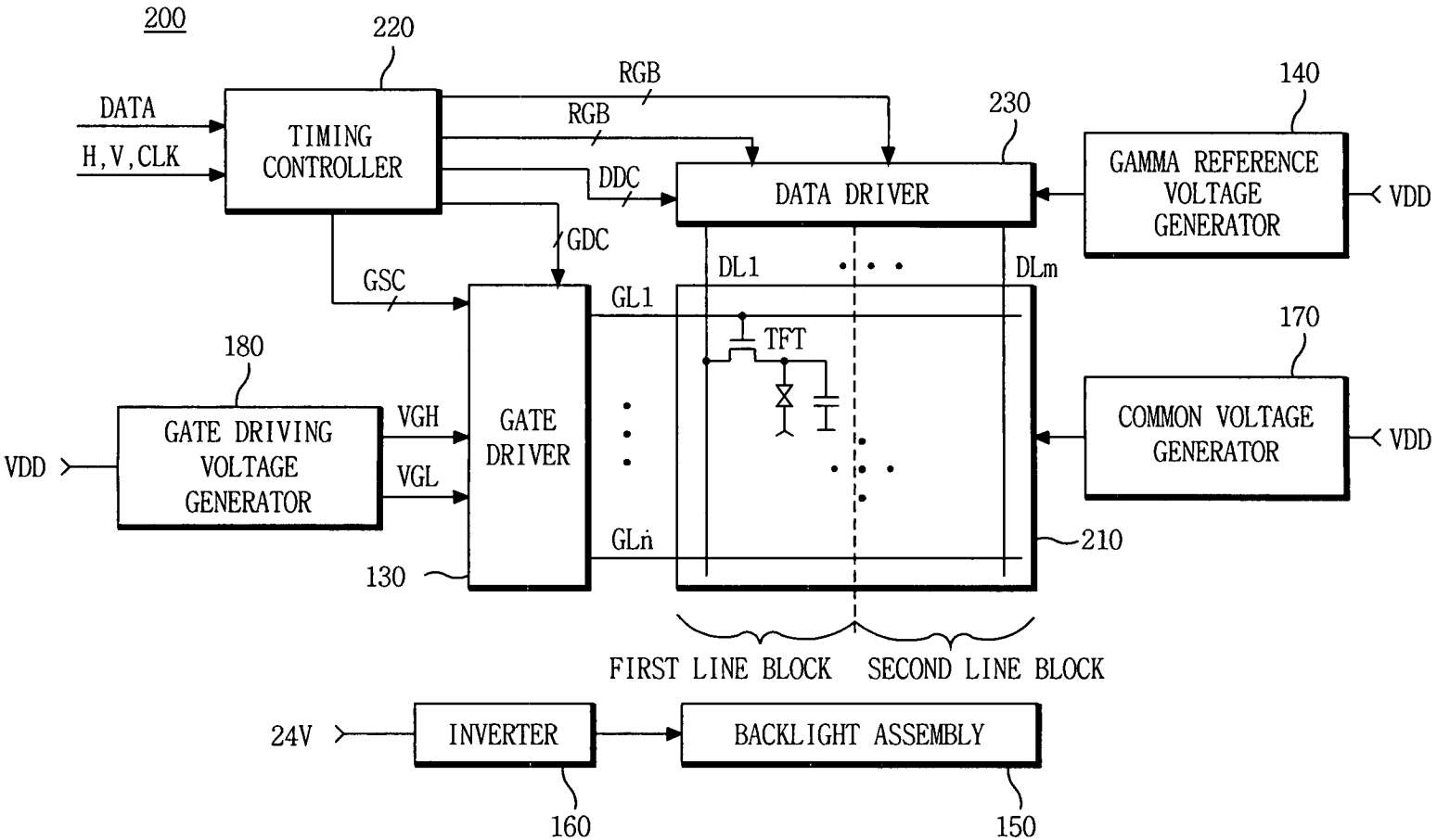
FIG. 4 shows a schematic diagram of an LCD device in accordance with an embodiment of the present invention.

FIG. 4 shows a schematic diagram of an LCD device in accordance with an embodiment of the present invention. Referring to FIG. 4, an LCD device 200 includes a gate driver 130, a gamma reference voltage generator 140, a backlight assembly 150, an inverter 160, a common voltage generator 170 and a gate driving voltage generator 180. The LCD device 200 further includes an LCD panel 210, a timing controller 220, and a data driver 230.

The timing controller 220 evenly distributes and stores first input data, such as a digital RGB video data or a digital RGB image data, to be supplied to an odd-numbered data line. The stored first data are simultaneously read and outputted to the corresponding odd-numbered data line during two divided clock periods. Similarly, the timing controller 220 evenly distributes and stores second input data, such as a digital RGB video data or a digital RGB image data, to be supplied to an even-numbered data line. The stored second data are simultaneously read and outputted to the corresponding even-numbered data line during two divided clock periods.

The LCD panel 210 includes a plurality of data lines divided into a first and second line blocks. The data driver 230 evenly distributes the first data from the timing controller 220 to odd-numbered data lines of the first and second lines blocks, and evenly distributes the second data from the timing controller 220 to even-numbered data lines of the first and second lines blocks in accordance with a control of the timing controller 220.

The LCD panel 210 is formed of two glass substrates (not shown) and a liquid crystal material (not shown) injected between two glass substrates. Data lines DL1 to DLm and gate lines GL1 to GLn perpendicularly cross each other on one of the glass substrates of the LCD panel 210. Each crossing of the data lines DL1 to DLm with the gate lines GL1 to GLn is provided with a TFT and a liquid crystal cell Clc.

The plurality of data lines DL1 to DLm are divided into a first and second line blocks. The data lines of the first line block are symmetrical with and simultaneously driven with the data lines of the second line block by the data driver 230. For example, the first data lines of the first and second line blocks are simultaneously driven, and the last data lines of the first and second line blocks are simultaneously driven.

In an embodiment of the present invention, the timing controller 220 evenly distributes input RGB data to be supplied to odd-numbered data lines and stores the RGB data in at least two first storage parts. Then, the timing controller 220 simultaneously reads and out puts the stored RGB data from the at least two first storage parts to the data driver 230 during two divided clock periods. Similarly, the timing controller 220 evenly distributes RGB data to be supplied to even-numbered data lines and stores the RGB data in at least two second storage parts. Then, the timing controller 220 simultaneously reads and outputs the stored RGB data from the at least two second storage parts to the data driver 230 during two divided clock periods. In an embodiment, the stored RGB data are read in parallel from the storage parts. Thus, the timing controller 220 converts the parallel read data into a serial data to be outputted to the data driver 230.

The data driver 230 evenly distributes data received from the timing controller 220 to odd-numbered data lines of the first and second line blocks, and evenly distributes data received from the timing controller 220 to even-numbered data lines of the first and second line blocks. For example, the data driver 230 divides 72 bits of data from the timing controller 220 into a first portion of 36 bits of data supplied to the odd-numbered data line of the first line block and a second portion of 36 bits of data supplied to the odd-numbered data lines of the second line block. As described above, the odd-numbered data lines of the first line block are symmetrical with the odd-numbered data lines of the second line block. Moreover, the first and second portions of 36-bit data are simultaneously supplied to the odd-numbered data lines of the first and second line blocks, respectively.

In another example, the data driver 230 divides 72 bits of data from the timing controller 220 into a first portion of 36 bits of data supplied to the even-numbered data line of the first line block and a second portion of 36 bits of data supplied to the even-numbered data lines of the second line block. As described above, the even-numbered data lines of the first line block are symmetrical with the even-numbered data lines of the second line block. Moreover, the first and second portions of 36-bit data are simultaneously supplied to the even-numbered data lines of the first and second line blocks, respectively.

Figure 5:
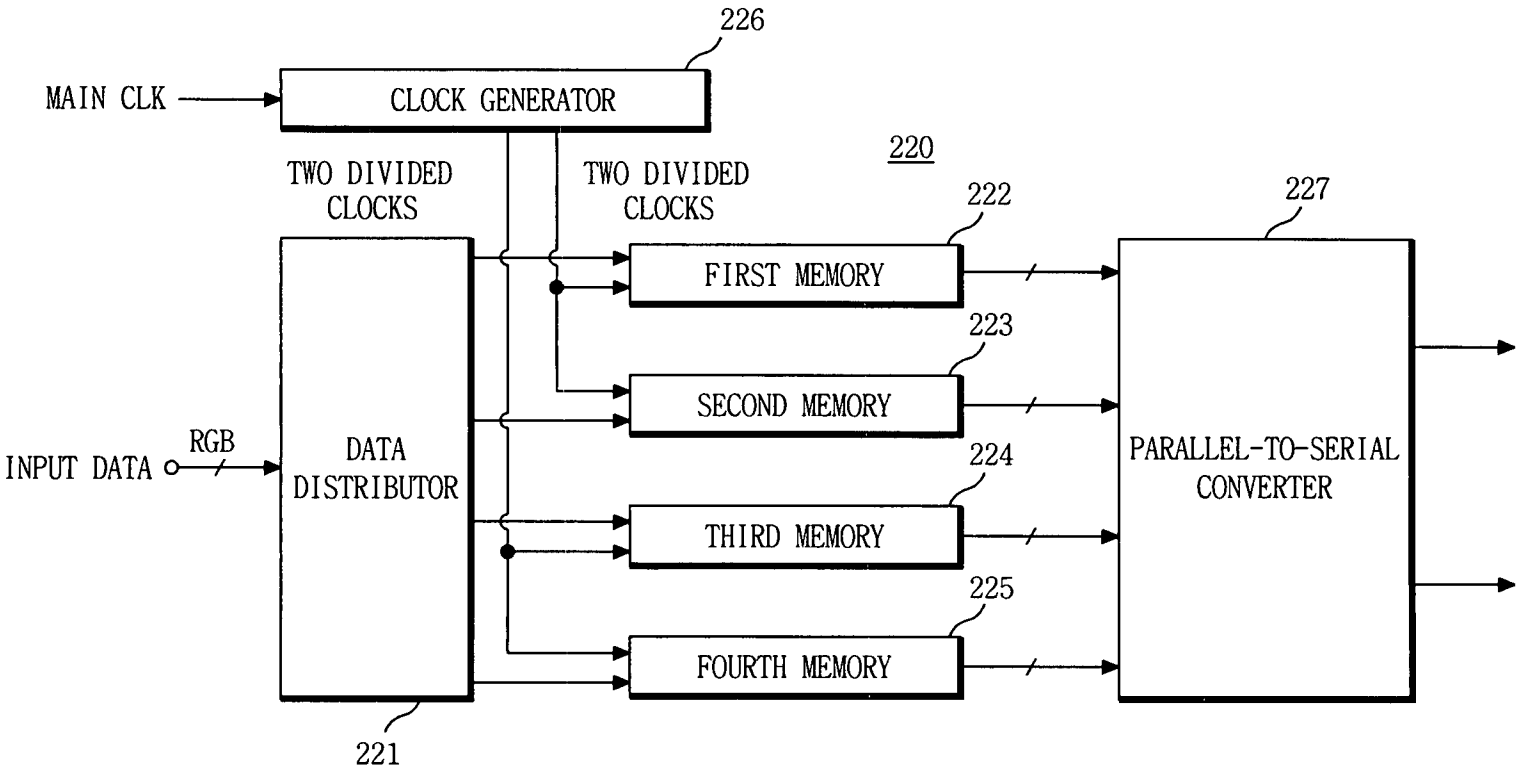
FIG. 5 shows a schematic description of a timing controller for the LCD device of FIG. 4 in accordance with an embodiment of the present invention.

FIG. 5 shows a schematic description of a timing controller for the LCD device of FIG. 4 in accordance with an embodiment of the present invention. Referring to FIG. 5, the timing controller 220 includes a data distributor 221, first and second memory parts 222 and 223, third and fourth memory parts 224 and 225, a clock generator 226, a parallel-to-serial converter 227. The data distributor 221 distributes input RGB data to the first to fourth memory parts 222, 223, 224 and 225. Data to be supplied to an odd-numbered data line are evenly stored in the first and second memory parts 222 and 223. Data to be supplied to an even-numbered data line are evenly stored in the third and fourth memory parts 224 and 225.

The clock generator 226 receives an input main clock (MAIN CLK) signal and generates two divided clock signals to control reading operations from the first to fourth memory parts 222 to 225. Specifically, the clock generator 226 generates a first divided clock signal for controlling reading and outputting of the data stored in the first and second memory parts 222 and 223. The first divided clock signal is simultaneously supplied it to the first and second memory parts 222 and 223. The clock generator 226 also generates a second divided clock signal for controlling reading and outputting of the data stored at the third and fourth memory parts 224 and 225. The second divided clock signal is simultaneously supplied it to the third and fourth memory parts 224 and 225. Moreover, the first and second divided clock signals are alternatively applied to first and second memory parts 222 and 223 and to the third and fourth memory parts 224 and 225, respectively.

The data distributor 221 distributes input RGB data to be supplied to an odd-numbered data line to the first and second memory parts 222 and 223. Alternatively, the data distributor 221 distributes input RGB data to be supplied to an even-numbered data line to the third and fourth memory parts 224 and 225. For example, if 72 bits of input RGB data are to be provided to the odd-numbered data line, the data distributor 221 divides the 72 bits of input RGB data into a first 36-bit part and a second 36-bit part. Then, the data distributor 221 stores the first and second 36-bit parts at the first and second memory parts 222 and 223, respectively. Similarly, if 72 bits of input RGB data are to be provided to the even-numbered line, the data distributor 221 divides the 72 bits of input RGB data into a third 36-bit part and a fourth 36-bit part. Then, the data distributor 221 stores the third and fourth 36-bit parts at the third and fourth memory parts 224 and 225, respectively.

The first memory part 222 stores an 18-bit input data received from the data distributor 221 at each divided clock cycle. Thus, the first memory part 222 can store 36 bits of input data during a period of two divided clocks from the clock generator 226. Data stored in the first memory part 222 correspond to an odd-numbered data line of the first line block.

The second memory part 223 stores an 18-bit input data received from the data distributor 221 at each divided clock cycle. Thus, the second memory part 223 can store 36 bits of input data during a period of two divided clocks from the clock generator 226. Data stored in the second memory part 223 correspond to an odd-numbered data line of the second line block.

The parallel-to-serial converter 227 converts a parallel data simultaneously read from the first and second memory parts 222 and 223 into a first serial data, which is outputted to the data driver 230 (shown in FIG. 4). For example, 36 bits of stored data are outputted in parallel from the first and second memory parts 222 and 223 to the parallel-to-serial converter 227 at each divided clock cycle. Hence, 72 bits of stored data may be outputted in parallel from the first and second memory parts 222 and 223 to the parallel-to-serial converter 227 during a period of two divided clocks.

According to an embodiment of the present invention, 72 bits of input data to be supplied to the odd-numbered data line are divided into first and second 36-bit parts stored at the first and second memory parts 222 and 223, respectively. The first and second 36-bit parts are simultaneously read from the first and second memory parts 222 and 223, respectively. The 36-bit data outputted from the first memory part 222 are supplied to the odd-numbered data line of the first line block and, at the same time, the 36-bit data outputted from the second memory part 223 are supplied to the odd-numbered data line of the second line block. Thus, a data reading time is reduced in half in comparison to the related art.

The third memory part 224 stores an 18-bit input data received from the data distributor 221 at each divided clock cycle. Thus, the third memory part 224 can store 36 bits of input data during a period of two divided clocks from the clock generator 226. Data stored in the third memory part 224 correspond to an even-numbered data line of the first line block.

The fourth memory part 225 stores an 18-bit input data received from the data distributor 221 at each divided clock cycle. Thus, the fourth memory part 225 can store 36 bits of input data during a period of two divided clocks from the clock generator 226. Data stored in the fourth memory part 225 correspond to an even-numbered data line of the second line block.

The parallel-to-serial converter 227 converts a parallel data simultaneously read from the third and fourth memory parts 224 and 225 into a second serial data, which is outputted to the data driver 230 (shown in FIG. 4). For example, 36 bits of stored data are outputted in parallel from the third and fourth memory parts 224 and 225 to the parallel-to-serial converter 227 at each divided clock cycle. Hence, 72 bits of stored data may be outputted in parallel from the third and fourth memory parts 224 and 225 to the parallel-to-serial converter 227 during a period of two divided clocks.

According to an embodiment of the present invention, 72 bits of input data to be supplied to the even-numbered data line are divided into third and fourth 36-bit parts stored at the third and fourth memory parts 224 and 225, respectively. The third and fourth 36-bit parts are simultaneously read from the third and fourth memory parts 224 and 225, respectively. The 36-bit data outputted from the third memory part 224 are supplied to the even-numbered data line of the first line block and, at the same time, the 36-bit data outputted from the fourth memory part 225 are supplied to the even-numbered data line of the second line block. Thus, a data reading time is reduced in half in comparison to the related art.

The parallel-to-serial converter 227 converts a parallel data read from the first and second memory parts 222 and 223, or from the third and fourth memory parts 224 and 225 into a serial data, which is outputted to the data driver 230.

Figure 6:
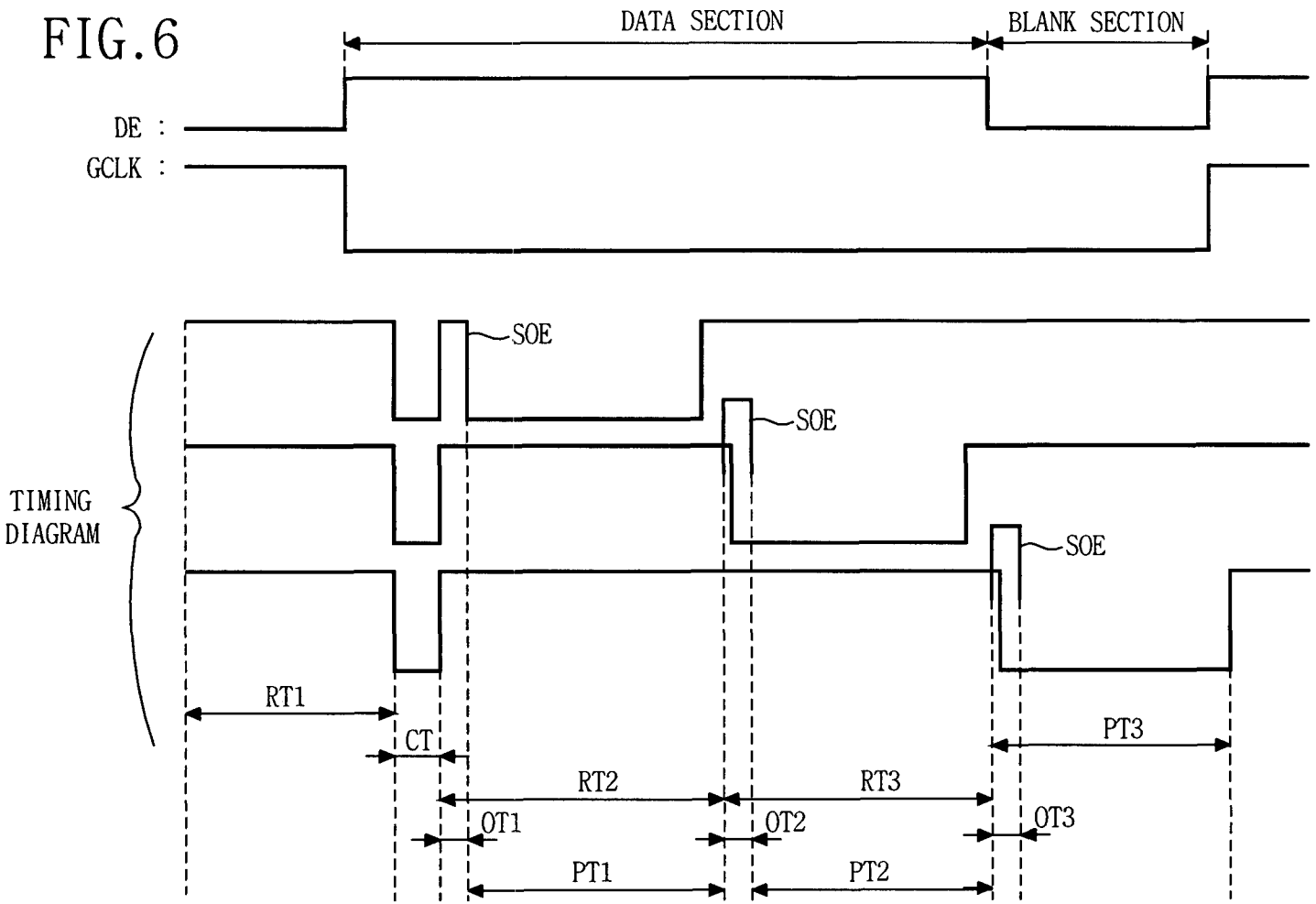
FIG. 6 shows an exemplary timing diagram of an operation of an LCD device according to an embodiment of the present invention.

FIG. 6 shows an exemplary timing diagram of an operation of an LCD device according to an embodiment of the present invention. Referring to FIG. 6, an externally provided data enable (DE) signal and a gate clock (GCLK) signal from the timing controller 220 are provided to the data driver 230 for supplying RGB data to the data line in accordance with a timing sequence. The RGB data may be 36 bits of data evenly stored at the first and second memory parts 222 and 223.

During a first RT1 period, the timing controller 220 reads R data stored at the first and second memory parts 222 and 223 and the data driver 230 supplies the read R data to the odd-numbered data line of the first and second line blocks. The data driver 230 pre-charges pixels positioned on the LCD panel 110 during a CT period following the first RT1 period, and the timing controller 220 supplies a high-level data output enable (SOE) signal to the data driver 230 during an OT1 period following the CT period. The data driver 230 performs a charge sharing function during the OT1 period, and then supplies the read R data to the odd-numbered data line of the first and second line blocks during a PT1 period.

During a second RT2 period, the timing controller 220 reads G data stored at the first and second memory parts 222 and 223. Then, the data driver 230 supplies the read G data to the odd-numbered data line of the first and second line blocks. The timing controller 220 supplies a high-level SOE signal to the data driver 230 during an OT2 period following the RT2 period and the PT1 period. The data driver 230 performs a charge sharing function during the OT2 period, and then supplies the read G data to the odd-numbered data line of the first and second line blocks during a PT2 period.

During a third RT3 period, the timing controller 220 reads B data stored at the first and second memory parts 222 and 223. Next, the data driver 230 supplies the read B data to the odd-numbered data line of the first and second line blocks during a PT3 period. Herein, the timing controller 220 supplies a high-level data SOE signal to the data driver 230 during an OT3 period following the RT3 period and the PT2 period. The data driver 230 performs a charge sharing function during the OT3 period, and then supplies the read B data to the odd-numbered data line of the first and second line blocks during the PT3 period.

The timing diagram of FIG. 6 can also be applied for reading 36 bits of RGB data evenly stored at the third and fourth memory parts 224 and 225. Then, the LCD device 200 supplies the read RGB data to the even-numbered data lines of the first and second line blocks.

As shown in FIG. 6, data is provided during a data section of the DE signal and no data is provided during a blank section of the DE signal. Accordingly, the present invention reduces reading sections RT1, RT2 and RT3 of RGB data, so that it becomes possible to reduce a blank section of the data enable signal DE.

In an embodiment of the present invention, a timing controller evenly distributes input RGB data to be supplied to an odd-numbered data line and stores the RGB data in at least two first storage parts. Then, the timing controller simultaneously reads and outputs the stored RGB data from the at least two first storage parts to a data driver during two divided clock periods. Similarly, the timing controller evenly distributes RGB data to be supplied to an even-numbered data line and stores the RGB data in at least two second storage parts. Then, the timing controller simultaneously reads and outputs the stored RGB data from the at least two second storage parts to the data driver 230 during two divided clock periods. Moreover, the stored RGB data are read in parallel from the storage parts. Accordingly, a blank section of a data enable signal is substantially reduced.

It will be apparent to those skilled in the art that various modifications and variations can be made in embodiments of the present invention. Thus, it is intended that embodiments of the present invention cover the modifications and variations of the embodiments described herein provided they come within the scope of the appended claims and their equivalents.

What is claimed is:

1. A liquid crystal display device, comprising:

a liquid crystal display panel providing a plurality of data lines;

a data distributor distributing data;

a first memory and a second memory equally storing first data to be supplied to a plurality of odd-numbered data lines among the data distributed by the data distributor;

a third memory and a fourth memory equally storing second data to be supplied to a plurality of even-numbered data lines among the data distributed by the data distributor;

a clock generator generating a divided clock for reading and outputting the first data stored at the first memory and the second memory or the second data stored at the third memory and the fourth memory; and a parallel-to-serial converter converting a parallel data simultaneously read from the first memory and second memory or simultaneously read from the third and fourth memory into a serial data, wherein the first data read from the first memory is supplied to the odd-numbered data lines of a first line block and, at the same time, the first data read from the second memory is supplied to the odd-numbered data lines of a second line block by the clock generator, wherein the second data read from the third memory is supplied to the even-numbered data lines of the first line block and, at the same time, the second data read from the fourth memory is supplied to the even-numbered data lines of the second line block by the clock generator, wherein the first line block is located at a left region of the liquid crystal display panel, wherein the second line block is located at a right region of the liquid crystal display panel, wherein the first data from the first and second memories simultaneously are supplied to the odd-numbered data lines of the first and second line blocks, wherein the second data from the third and fourth memories simultaneously are supplied to the even-numbered data lines of the first and second line blocks, and wherein a start period of the first data of the odd-numbered data lines of the first and second line blocks is different from a start period of the second data of the even-numbered data lines of the first and second line blocks.

2. The liquid crystal display device as claimed in claim 1, wherein 36-bit data to be supplied to the odd-numbered data lines are stored at the first and second memories, respectively.

3. The liquid crystal display device as claimed in claim 2, wherein the clock generator two-divides a main clock inputted from a system to simultaneously supply two divided clocks to the first memory and the second memory.

4. The liquid crystal display device as claimed in claim 3, wherein the 36-bit data stored at the first memory and the second memory are all read for the two divided clocks that are supplied.

5. The liquid crystal display device as claimed in claim 1, wherein 36-bit data to be supplied to the even-numbered data lines are stored at the third memory and the fourth memory, respectively.

6. The liquid crystal display device as claimed in claim 5, wherein the clock generator two-divides a main clock inputted from a system to simultaneously supply two divided clocks to the third memory and the fourth memory.

7. The liquid crystal display device as claimed in claim 6, wherein the 36-bit data stored at the third memory and the fourth memory are all read for the two divided clocks that are supplied.

8. A liquid crystal display device, comprising:

a liquid crystal display panel having a plurality of data lines divided into a first line block and a second line block, the data lines of the first line block are symmetrical with and simultaneously driven with the data lines of the second line block;

a data distributor distributing data;

a timing controller equally distributing and storing first data to be supplied to a plurality of odd-numbered data lines, and then simultaneously reading and outputting the first data during a plurality of divided clock periods and equally distributing and storing second data to be supplied to a plurality of even-numbered data lines, and then simultaneously reading and outputting the second data during the plurality of divided clock periods; and a data driver equally distributing the first data supplied from the timing controller to supply the first data to the odd-numbered data lines of the first line block and the second line block, and equally distributing the second data supplied from the timing controller to supply the second data to the even-numbered data lines of the first line block and the second line block in accordance with a control of the timing controller;

a first memory and a second memory equally storing the first data to be supplied to the odd-numbered data lines among the data distributed by the data distributor;

a third memory and a fourth memory equally storing the second data to be supplied to the even-numbered data lines among the data distributed by the data distributor;

a clock generator generating a divided clock for reading and outputting the first data stored at the first memory and the second memory or the second data stored at the third memory and the fourth memory; and a parallel-to-serial converter converting a parallel data simultaneously read from the first memory and second memory, or the third and fourth memory into a serial data, wherein the first data read from the first memory is supplied to the odd-numbered data lines of the first line block and, at the same time, the first data read from the second memory is supplied to the odd-numbered data lines of the second line block by the clock generator, wherein the second data read from the third memory is supplied to the even-numbered data lines of the first line block and, at the same time, the second data read from the fourth memory is supplied to the even-numbered data lines of the second line block by the clock generator, wherein the first line block is located at a left region of the liquid crystal display panel, wherein the second line block is located at a right region of the liquid crystal display panel, wherein the first data from the first and second memories simultaneously are supplied to the odd-numbered data lines of the first and second line blocks, wherein the second data from the third and fourth memories simultaneously are supplied to the even-numbered data lines of the first and second line blocks, and wherein a start period of the first data of the odd-numbered data lines of the first and second line blocks is different from a start period of the second data of the even-numbered data lines of the first and second line blocks.

9. The liquid crystal display device as claimed in claim 8, wherein 36-bit data to be supplied to the odd-numbered data lines are stored at the first memory and the second memory, respectively.

10. The liquid crystal display device as claimed in claim 9, wherein the clock generator two-divides a main clock inputted from a system to simultaneously supply two divided clocks to the first memory and the second memory.

11. The liquid crystal display device as claimed in claim 10, wherein the 36-bit data stored at the first memory and the second memory are all read for the two divided clocks that are supplied.

12. The liquid crystal display device as claimed in claim 8, wherein 36-bit data to be supplied to the even-numbered data lines are stored at the third memory and the fourth memory, respectively.

13. The liquid crystal display device as claimed in claim 12, wherein the clock generator two-divides a main clock inputted from a system to simultaneously supply two divided clocks to the third memory and the fourth memory.

14. The liquid crystal display device as claimed in claim 13, wherein the 36-bit data stored at the third memory and the fourth memory are all read for the two divided clocks that are supplied.

15. A method of driving a liquid crystal display device, the method comprising:

distributing data from a system;

equally storing first data to be supplied to a plurality of odd-numbered data lines among the distributed data at a first memory and a second memory;

equally storing second data to be supplied to a plurality of even-numbered data lines among the distributed data at a third memory and a fourth memory;

during a divided clock supply period, dividing a main clock supplied from the system for simultaneously reading the first data of the first memory and the second memory or simultaneously reading the second data of the third memory and the fourth memory; and a parallel-to-serial converter converting a parallel data simultaneously read from the first memory and second memory, or the third and fourth memory into a serial data, wherein the first data read from the first memory is supplied to the odd-numbered data lines of a first line block and, at the same time, the first data read from the second memory is supplied to the odd-numbered data lines of a second line block by the clock generator, wherein the second data read from the third memory is supplied to the even-numbered data lines of the first line block and, at the same time, the second data read from the fourth memory is supplied to the even-numbered data lines of the second line block by the clock generator, wherein the first line block is located at a left region of the liquid crystal display panel, wherein the second line block is located at a right region of the liquid crystal display panel, wherein the first data from the first and second memories simultaneously are supplied to the odd-numbered data lines of the first and second line blocks, wherein the second data from the third and fourth memories simultaneously are supplied to the even-numbered data lines of the first and second line blocks, and wherein a start period of the first data of the odd-numbered data lines of the first and second line blocks is different from a start period of the second data of the even-numbered data lines of the first and second line blocks.

16. The method of driving the liquid crystal display device as claimed in claim 15, wherein 36-bit data to be supplied to the odd-numbered data lines are stored at the first memory and the second memory, respectively.

* * * * *